United States Patent [19]

Squire

[11] 4,295,646

[45] Oct. 20, 1981

[54] KARATE BOARD HOLDING AND STORAGE DEVICE

[76] Inventor: Dereck Squire, 265 Grove St., Apt. C-30, Elizabeth, N.J. 07202

[21] Appl. No.: 91,236

[22] Filed: Nov. 5, 1979

[51] Int. Cl.[3] ..... A63B 69/00

[52] U.S. Cl. ..... 272/76

[58] Field of Search ..... 272/78, 76; 108/111, 108/109; 217/59, 62; 43/61, 62; 403/212; 206/9; 248/97, 99, 165, 188.8, 346

[56] References Cited

U.S. PATENT DOCUMENTS 2,375,726 5/1945 Bales ..... 108/109

3,125,970 3/1964 Schneider ..... 108/109

FOREIGN PATENT DOCUMENTS 2728551 6/1977 Fed. Rep. of Germany ..... 108/109

OTHER PUBLICATIONS

Black Belt, Jan. 1979, p. 18.

*Primary Examiner*—Richard C. Pinkham

*Assistant Examiner*—T. Brown

*Attorney, Agent, or Firm*—Robert D. Farkas

[57] ABSTRACT

A board holding and storage device utilizes four upright posts assembled together into a rectangular framework having a pair of L-shaped brackets secured to the frontmost opposed posts when the rearmost opposed posts are supported on a vertical supporting surface. A crossbar, connected to the frontmost posts and disposed beneath the frontmost pairs of angular L-shaped members is utilized to retain a vertically disposed board in supported relationship disposed parallel to the supporting surfaces, as required to be held during a gymnastic board breaking exercise. A shelf-like structure secured to the bottom of the posts provides storage access for a plurality of boards stored thereon.

8 Claims, 3 Drawing Figures

KARATE BOARD HOLDING AND STORAGE DEVICE

BACKGROUND OF THE INVENTION

1. The Field of the Invention

This invention relates to board holding devices and more particularly to that class of apparatus in which boards may be removeably disposed in selected angular relationship in use or storage positions relative to a vertical supporting surface.

2. Description of the Prior Art

The prior art abounds with stands or holding devices for various devices. U.S. Pat. No. 2,713,471 issued July 19, 1955 to E. D. Harsch discloses a telephone stand in which an oval or circular type base of a telephone is disposed installed between two L-shaped members grasping the marginal edges of the base and having a telephone base supporting contacting surface. Such apparatus, though grasping the edges of a substantially sheet-like member, in so far as the marginal edges of the telephone base is concerned, fails to support such device only in the regions of the marginal edges and hence makes such apparatus totally ineffective in board breaking exercises.

U.S. Pat. No. 3,826,455 issued July 30, 1974 to W. J. O'Donnell teaches a pair of U-shaped inverted wire-like members disposed in parallel spaced apart relationship and having the free ends of the U-shaped members secured to a base. Such apparatus though sufficient for purposes of storage of boards intermediate the U-shaped members fails to secure a single board in a vertical aligned position relative to a supporting surface and secured outwardly therefrom.

U.S. Pat. No. 3,484,810 issued Dec. 16, 1969 to M. Boss describes a free standing display stand having an L-shaped leg-like member, and upon the vertically aligned leg thereof a bracket is disposed in various vertical positions. A shelf is supported on such bracket to an adjacent bracket disposed at selected heights on an adjacently disposed L-shaped member. Though such apparatus is adjustable in width so as to permit a variety of variable width shelves to be disposed thereon no provisions are made to support a vertical member securely from a vertical supporting surface.

SUMMARY OF THE INVENTION

A primary object of the present invention is to provide a supporting device which will hold side marginal edges of a board in spaced apart vertical alignment with a vertical supporting surface.

Another object of the present invention is to provide a shelf-like structure disposed below a vertical board holding apparatus for storage of boards thereon.

Still another object of the present invention is to provide an apparatus which is decorative in nature yet totally effective for purposes of supporting a board for board breaking exercises.

Yet another object of the present invention is to provide a wall mounting apparatus which is rugged in construction yet simple to construct.

A further object of the present invention is to provide a shelf-like surface for the purposes of receiving broken board pieces thereon after a successful board breaking exercise has been consummated.

The martial arts, such as karate, kung-fu, and the like require that board-like members, usually in the form of wooden boards, be held at their vertically disposed marginal edges by a partner, so that the active participant may punch at the held board. The holding partner simply serves the purpose of providing vertical support to the marginal edges of the board to be punched. He does not in any way contribute to the exercise or practice of the individual who is utilizing such a supported board. The present invention provides support for one or more boards held in a vertical plane and outwardly from a vertical supporting surface to which the apparatus is affixed. Provisions are made for purposes of storing a plurality of unused boards below the location of the practice board, when installed in the apparatus. In this manner, a serious martial arts practioner can practice alone having a convenient storage facility for the practice boards and a location at a convenient height for the boards which he utilizes in the development of his skill. A shelf-like structure is provided directly below the location of the vertically disposed board for purposes of receiving the broken pieces thereof, after the board has been successfully broken. By grasping only defined portions of the vertically disposed marginal edges of the practice board, the martial art practioner is assured that the force required to break a given board is solely dependent upon the board construction as opposed to how a board might be held by manual grasping means.

These objects as well as other objects of the present invention will become more readily apparent after reading the following description of the accompanying drawings.

DESCRIPTION OF THE PREFERRED EMBODIMENT

The structure and method of fabrication of the present invention is applicable to four vertically disposed posts, preferably fabricated from wood. Each of the posts form a vertically disposed corner of an open framework and are joined together at the uppermost ends thereof by a pair of L-shaped angles extending horizontally in spaced apart parallel relationship. A pair of flat board-like members are attached to the rearmost vertical surfaces of a pair of the posts providing therefor a pair of surfaces which may be attached to a vertical supporting surface. The uppermost flat member may have a thin decorated sheet disposed in between such member and the adjacent pair of vertical posts, providing a decorated surface or, if desired, providing resilient surface for safety purposes. A pair of block-like members are disposed extending horizontally and joining pair of opposed post members, extending beneath the aforementioned pair of angular members. The frontmost posts are provided with opposed pairs of L-shaped angles having opposed legs defining a pair of tracks. Each of the tracks extend parallel to the board-like members and define an opening in which a board may be held by removeable insertion of the marginal edges into the aligned tracks. Such board is prevented from further sliding motion downward by a bar-like wooden members disposed joining together the pair of front posts and residing in a horizontal direction. A shelf-like sheet is provided underneath the bar-like member and extends towards the rear opposed vertical surfaces of the rearmost pairs of posts. Another shelf-like member extends horizontally along the length of the vertical opposed innermost surfaces of each of the four posts. Holes are provided for securing the apparatus to a vertical mounting surface in each of the board-like members. The angles are secured to the posts utilizing wood screws passing through openings in such angles. Each of the board-like members and the sheet-like members may be fabricated from a wooden material, if desired. The size of the lowermost shelf member, the position of the four vertically disposed posts, and the spacing between the lowermost shelf member and its companion uppermost shelf are configured to provide an adequate storage space for boards maintained one above the other, resting on such lowermost shelf. These boards may each be individually inserted into the tracks therefor providing vertical support for such boards in a vertical plane, spaced apart from the vertically aligned supporting surface.

Figure 1:
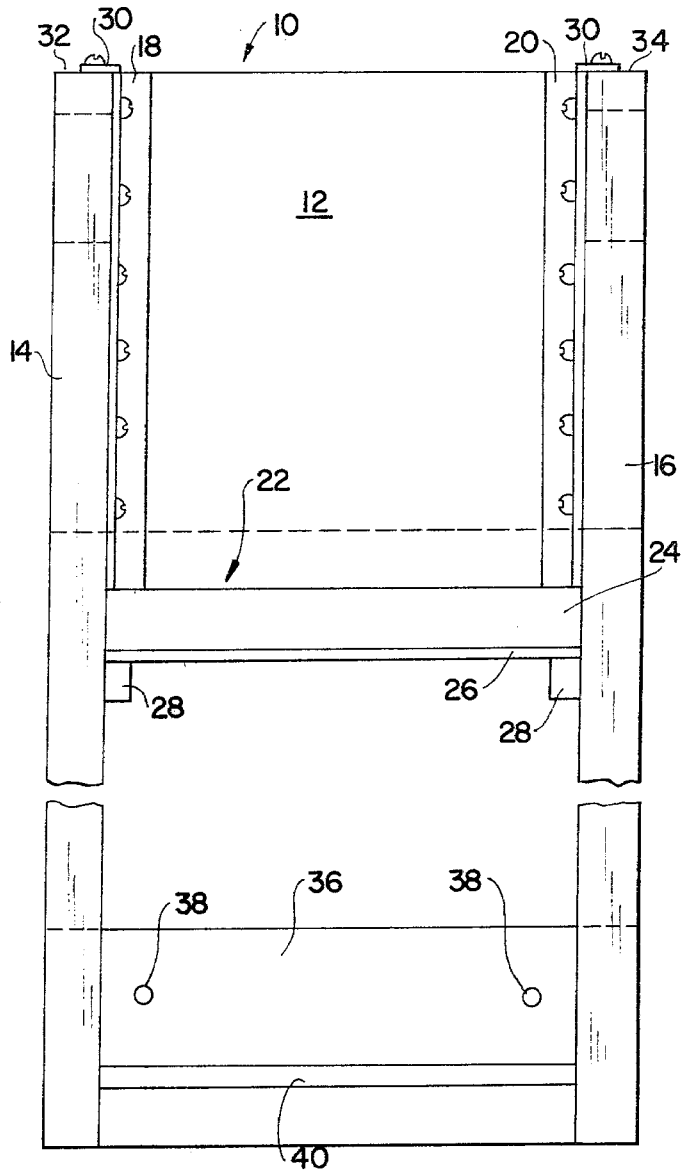
FIG. 1 is a front elevation view of the present invention.

Now referring to the figures, and more particularly to the embodiment illustrated in FIG. 1 showing the present invention 10 in which board 12 reposes in a vertical plane. Posts 14 and 16 are each provided having L-shaped angles 18 and 20 respectively secured grasping the marginal edges of board 12. The lowermost marginal edge 22 of board 12 is shown resting on bar member 24. Sheet member 26 extends below bar member 24. Sheet member 26 is shown supported by bars 28. L-shaped angles 30 reside on ends 32 and 34, of posts 14 and 16 respectively. Sheet-like member 36 is shown provided with holes 38 for mounting purposes. Shelf-like member 40 is shown straddling legs 14 and 16.

Figure 2:
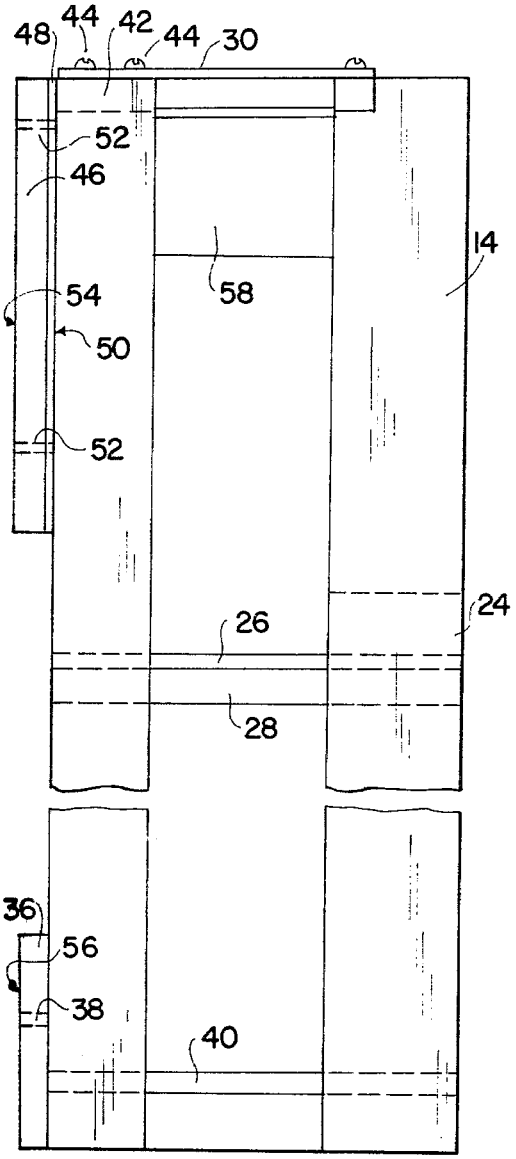
FIG. 2 is a side elevation view of the present invention.

FIG. 2 illustrates post 42 upon which L-shaped angle 30 is secured, utilizing bolts 44 therefor. Rigid sheet-like member 46 is shown secured to sheet-like member 48. Sheet-like member 48 is shown secured to post 42, in any convenient manner. Sheet-like member 48 may have surface 50 thereof decorated, if desired, or provided having a resilient characteristic. Holes 52 are used for purposes of mounting surface 54, of sheet member 46 to a vertical supporting surface, as is surface 56, of sheet member 36. Block 58 is shown disposed between posts 14 and 42.

Figure 3:
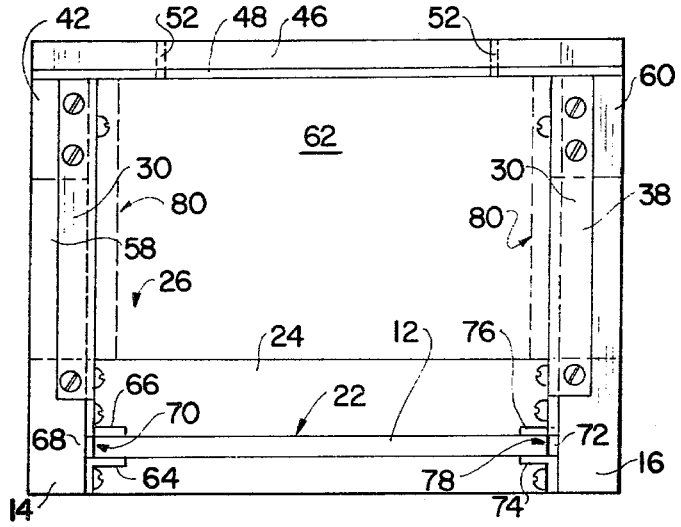
FIG. 3 is a plan view of the present invention.

FIG. 3 illustrates the spacial relationship of posts 14, 16, 42 and 60 in a generally rectangular shape. Surface 62, of shelf member 26, is shown residing below surface 22, of bar member 24. L-shaped angles 64 and 66 form a track 68 in which marginal edge 70, of vertically disposed board 12 is located. Track 72 is defined by L-shaped angles 74 and 76, and is aligned with track 68, in which marginal edge 78, of board 12, reside. Dotted lines 80 represent marginal edges of supporting bars 28, shown in FIGS. 1 and 2.

One of the advantages of the present invention is a supporting device which will hold side marginal edges of a board in spaced apart vertical alignment with a vertical supporting surface.

Another advantage of the present invention is a shelf-like structure disposed below a vertical board holding apparatus for storage of boards thereon.

Still another advantage of the present invention is an apparatus which is decorative in nature yet totally effective for purposes of supporting a board for board breaking exercises.

Yet another advantage of the present invention is a wall mounting apparatus which is rugged in construction yet simple to construct.

A further advantage of the present invention is a shelf-like surface for the purposes of receiving broken board pieces thereon after a successful board breaking exercise has been consummated.

Thus, there is disclosed in the above description and in the drawings, an embodiment of the invention which fully and effectively accomplishes the objects thereof. However, it will become apparent to those skilled in the art, how to make variations and modifications to the instant invention. Therefor, this invention is to be limited, not by the specific disclosure herein, but only by the appending claims.

The embodiment of the invention in which an exclusive privilege or property is claimed are defined as follows:

1. A board holding and storage device comprising a first shelf and a second shelf, a frame, said frame including four posts, said first shelf and said second shelf disposed in parallel spaced apart relationship and secured to said frame, said four posts including a first pair of posts and a second pair of posts, said first pair of posts joined to said second pair by a pair of angle members, said first shelf extending transverse to the longitudinal axis of said four posts, said second shelf being juxtaposed to said first shelf, means to mount said frame to a vertical supporting surface, means to removeably secure the marginal edges of a board to said frame disposing said board parallel and spaced apart from said supporting surface, whereby said first shelf is disposed located in a horizontal plane extending below said board when said board is positioned having said marginal edges thereof secured to said frame and whereby said second shelf is configured to provide vertical support to said board when said board is disposed having a lateral surface thereof resting on an uppermost lateral surface of said second shelf.

2. The apparatus as claimed in claim 1 wherein said means to removeably secure said marginal edges of said board to said frame comprises two pairs of L-shaped angles, each of said pairs of said angles forming a track, said tracks being disposed in aligned relationship and defining a pair of vertically aligned openings in which said marginal edges of said board may be received in sliding relationship.

3. The apparatus as claimed in claim 1 wherein said means to mount said frame to said vertical supporting surface comprises a sheet-like member, said sheet-like member extending secured to said first pair of posts, said sheet-like member having a plurality of holes therein.

4. The apparatus as claimed in claim 3 further comprising another sheet-like member, said another sheet-like member interposed extending between said sheet-like member and said first pair of posts.

5. The apparatus as claimed in claim 4 wherein said another sheet-like member is fabricated from a resilient material.

6. The apparatus as claimed in claim 1 wherein said board is fabricated from wood.

7. The apparatus as claimed in claim 1 wherein said second shelf is spaced apart from said first shelf a distance sufficient to allow a plurality of said boards to be disposed in resting relationship on said second shelf in juxtaposed relationship to one another.

8. The apparatus as claimed in claim 1 wherein said board has a rectangular shape.

* * * * *